US010794009B2

(12) United States Patent
Lichtberger

(10) Patent No.: US 10,794,009 B2
(45) Date of Patent: Oct. 6, 2020

(54) TAMPING MACHINE FOR COMPACTING THE BALLAST BED OF A TRACK

(71) Applicant: HP3 Real GmbH, Vienna (AT)

(72) Inventor: Bernhard Lichtberger, Pregarten (AT)

(73) Assignee: HP3 Real GmbH, Vienna (AT)

( * ) Notice: Subject to any disclaimer, the term of this patent is extended or adjusted under 35 U.S.C. 154(b) by 239 days.

(21) Appl. No.: 15/569,513

(22) PCT Filed: May 20, 2016

(86) PCT No.: PCT/AT2016/050148
§ 371 (c)(1),
(2) Date: Oct. 26, 2017

(87) PCT Pub. No.: WO2016/191776
PCT Pub. Date: Dec. 8, 2016

(65) Prior Publication Data

US 2018/0298564 A1 Oct. 18, 2018

(30) Foreign Application Priority Data

Jun. 2, 2015 (AT) ..... 50447/2015

(51) Int. Cl.
*E01B 27/17* (2006.01)

(52) U.S. Cl.
CPC ..... *E01B 27/17* (2013.01)

(58) Field of Classification Search
CPC ..... E01B 27/17; E01B 27/16
See application file for complete search history.

(56) References Cited

U.S. PATENT DOCUMENTS 4,589,343 A * 5/1986 Hurni ..... E01B 27/17 104/7.2
5,052,306 A * 10/1991 Theurer ..... E01B 27/17 104/12
5,515,788 A * 5/1996 Theurer ..... E01B 27/17 104/12
2001/0042487 A1* 11/2001 Perry ..... E01B 27/18 104/2
2014/0318407 A1* 10/2014 Ibanez Latorre ..... E01B 27/17 104/7.1

FOREIGN PATENT DOCUMENTS

CH 705 271 A2 1/2013

OTHER PUBLICATIONS

Espacenet. English Language Abstract of CH 705 271 A2. Draco SA, Jan. 15, 2013.

* cited by examiner

*Primary Examiner* — Scott A Browne
(74) *Attorney, Agent, or Firm* — Tiajoloff & Kelly LLP

(57) ABSTRACT

The invention relates to a tamping machine (1) for compacting the ballast bed of a track (9), comprising tamping units (4) for tamping a track (9), a lifting and lining device (2) for lifting and lining tracks and switches (9), said device being arranged between the running gears (8), preferably in front of the tamping units (4) in the working direction (C), and comprising lifting rollers (6) and lifting hooks (7). In order to provide advantageous conditions it is proposed that the lifting roller (6) with its associated vertical guide (18) and the lifting hook (7) with its associated vertical guide are displaceably mounted along a common transverse guide (16) extending transversely to the longitudinal axis (L) of the tamping machine.

11 Claims, 5 Drawing Sheets

SdT 5
18
21
20
3
$F_H$
13
V
H
22
17
16
10
6
7
14
9
19

14
6
9

TAMPING MACHINE FOR COMPACTING THE BALLAST BED OF A TRACK

FIELD OF THE INVENTION

The invention relates to a tamping machine for compacting the ballast bed of a track, comprising tamping units for tamping a track, a lifting and lining device for lifting and lining tracks and switches, said device being arranged between the running gears and preferably in front of the tamping units in the working direction, and comprising lifting rollers and lifting hooks. Such lifting and lining devices are usually guided in a longitudinally displaceable manner in the longitudinal direction of the machine.

DESCRIPTION OF THE PRIOR ART

Switch tamping machines are machines for correcting the track position of switches and tracks. Measurement systems are used for determining the track position which measure the actual height position of the track, the actual direction of the track and the actual position of the superelevation of the track during work and adjust them to predetermined target values. The track grid is lifted by means of a track lifting/track lining unit and is laterally adjusted until the difference between the predetermined target position and actual position is zero. In this position, the switch is fixed by compacting the ballast beneath the sleepers by means of a switch tamping unit. The lifting and lining of the track grid occurs via hydraulic lifting and lining cylinders with proportional or servo control. Switches comprise a continuous track and a diverging track as a special feature. Trains are guided via so-called switch blades to the diverging track or held on the continuous main track. The so-called cross frog is disposed in the crossover point of the continuous track and the diverging track. In order to ensure that the wheel that is not guided in the interruption region rolls securely into the diverging track or the continuous main track, guide rails are provided. In order to ensure that the working tools of the switch tamping machine are capable of tamping beneath the sleepers of the switch at all locations, the tamping units are laterally displaceable and the tamping units are rotatable as a result of the obliquely disposed longitudinal sleepers. The tamping tines can additionally be formed in a pivotable manner at least in part.

In the case of pure track tamping machines, the rail is gripped at the head by roller pincers and lifted to the geometric target position. A use of the roller pincers is often not possible in switches due to the crossing rails and in the region of the cross frog. In order to ensure that these points can also be processed (and lined), laterally extendable and adjustable lifting hooks which are height adjustable in the depth are additionally provided.

The machine operator controls the position of the tamping unit and the tines from the cabin. The operator selects the roller pincers or the lifting hook or the position of the lifting hook as well as the point of attack thereof on the rail head or rail base according to the conditions and as required. The lifting device can also be displaced in the longitudinal direction of the track. This is necessary when the lifting hook acts on the rail base (which is only possible in the region of the intermediate compartment) or when the roller pincers or the lifting hook for example are unable to act on the rail head due to an insulated joint.

The conventional articulated arrangement of the roller pincers has the disadvantage that the pincers are often forced open and pulled out by the lifting forces. Another disadvantage of this design of the roller pincers closing around one pivot point is that the roller has to be adjusted manually under respective wear or with different head rail heights. If the height of the roller pincers is not adapted to the conditions, then the lining roller is lifted off the rail by the available play. This leads to an undesired load on the rail head further at the top and tends to result in a slipping of the lining roller with subsequent derailment. Another disadvantage is that rotatable roller pincers must be integrated into the lifting and lining unit in such a way that accessibility is impaired. This increases the time required for maintenance work or repair work. Adjusting the roller in the vertical direction also requires corresponding time and cost.

In addition, a deviation in the operation of the command devices by the operator is caused by the different operating mode of the roller pincers and the lifting hook.

SUMMARY OF THE INVENTION

The invention is therefore based on the object of finding an embodiment of the roller pincers with reduced tear-out tendency of the roller pincers and of the lifting hook, wherein an automatic adjustment of the roller in case of wear or different rail heights is possible and the accessibility of the roller pincers is to be improved so as to enable simplified maintenance and repair. The invention is intended to enable unified and simplified operation.

This object is achieved by the invention in that that the lifting roller with its associated vertical guide and the lifting hook with its associated vertical guide are displaceably mounted along a common transverse guide extending transversely to the longitudinal direction of the tamping machine. The lifting roller and lifting hook can thus be displaced along a common transverse guide transversely to the direction of travel of the tamping machine. This allows unifying and simplifying the operation of the installation since both tools can at least be displaced approximately in a plane transversely to the direction of travel of the tamping machine and can be displaced in the same manner between a retracted rest position and a working position extended against the track. The lifting roller and lifting hook can thereby be displaced independently of each other along straight guides parallel to a machine vertical axis. In this case, the lifting roller and lifting hook can preferably be displaced independently along straight guides parallel to the machine vertical axis. In addition, the lifting roller and lifting hook can be displaced independently of one another or together along the transverse guide transversely to the longitudinal direction of the tamping machine. The lifting roller is thus guided vertically and horizontally like the lifting hook.

It is particularly advantageous, since it is simple and robust, if the lifting roller with the assigned vertical guide and the lifting hook with associated vertical guide are arranged in a common bracket and are displaceably mounted along the common transverse guide with the bracket. The lifting hook and lifting roller are guided along a common guide for each vehicle side. The lifting roller is lowered like a lifting hook via a vertical guide. The bracket is moved horizontally inward towards the centre of the vehicle for producing the connection like the lifting hook, and the lifting roller is applied to the rail. The lifting roller is then moved upwards until it rests on the underside of the rail head. This avoids the dependence on the wear of the roller or different rail head heights. Readjustment of the roller is no longer necessary. The operation is carried out in respect of the sequence by the embodiment in accordance with the invention like that of the lifting hook. Due to the interlocking connection between the lifting roller, the rail head and the lining roller, it is possible to avoid the lifting roller from being forced apart and torn open.

According to the invention, the bracket is moved along a guide transversely to the track. For this purpose, it is advisable if the lifting roller is associated with a vertical guide cylinder and the lifting hook with a vertical guide cylinder of the common bracket, and the bracket is displaceably mounted along the transverse guide with a transverse sliding cylinder. On the bracket, the piston rods are supported by two hydraulic cylinders. A vertical guide cylinder with a smaller stroke serves for the vertical adjustment of the lifting roller. The other vertical guide cylinder with a longer stroke is provided for the lifting hook. The longer stroke is necessary so that the lifting hook can also act on the rail base. The hydraulic cylinders are connected to the lifting hook or the lifting roller, which in turn can be displaced up and down along vertical guides, on or in the bracket. The bracket with the lifting roller or lifting hook is brought into the respective transverse shifting position (lowering point of the lifting roller or the lifting hook) by means of a hydraulic cylinder lying transversely to the track and supported in particular on the lifting and lining unit. Subsequently, the lifting tool chosen by the user is lowered vertically until the intended gripping height is reached. Then the lifting tool with the bracket is moved inwards until the lifting tool has contact with the rail. In the subsequent process, it is raised until the interlocking connection between the lifting tool and the rail is produced.

If the lifting device is now subjected to the lifting force, the lining roller cannot be lifted from the track since there is an interlocking connection between the lifting tool and the rail. There is a clear reference to the rail via the lining roller which rests on the rail. Since the lining roller is connected to the lifting and lining device, this also provides a clear reference to the movements of the lifting tools with respect to the rail.

An advantageous embodiment of the invention is obtained when the hydraulic cylinders of the vertical guide and the transverse displacement are equipped with distance meters. With the aid of these distance meters, the entire closing operation of the lifting tools can be automated. For this purpose, the laterally necessary displacements and the vertical stroke values are predetermined as target values and compared with the actual values. This further reduces the burden on the operator.

A further advantage of the embodiment according to the invention with displacement sensors is that the unambiguous closing of the lifting tools and the associated interlocking connection can be measured and monitored.

If the lifting hook or the lifting roller cannot be placed underneath the rail head for example, since an insulated joint mechanically prevents the closing, this can be measured by way of the corresponding inadequate closing distance. In this case, the lifting hook can automatically be lowered more deeply in order to grip the rail for example. Another possibility is to move the lifting and lining unit parallel to the track in the longitudinal direction until the lifting roller or lifting hook can grip properly again.

According to the invention, the use of a common bracket and a common use of the transverse guide for the lifting roller and the lifting hook result in a simplification of the system, which is accompanied by uniform operating steps and which can be automated.

As a result of the vertically acting lifting force, a tearing out of the lifting rollers is prevented according to the invention. In the case of the otherwise used obliquely acting roller pincers, a horizontal component is produced by the acting vertical force on the roller, which acts in a manner that forces the closing device apart.

As a result of the embodiment according to the invention, the lifting devices are easily accessible and facilitate maintenance and repair. Conventional roller pincers are often designed to be double-acting (one roller each on the left and right side of the rail) and are integrated in the lifting and lining device in a manner difficult to access.

Since the lifting roller in the embodiment according to the invention is brought into an interlocking connection with the rail head by means of horizontal and vertical movements and this is regardless of the amount of the wear and tear of the lifting roller or the height of the rail head, the necessity for the adjustment of the lifting roller is avoided.

BRIEF DESCRIPTION OF THE DRAWING

The subject matter of the invention is shown in the drawings by way of example, wherein.

DESCRIPTION OF THE PREFERRED EMBODIMENT

Figure 1:
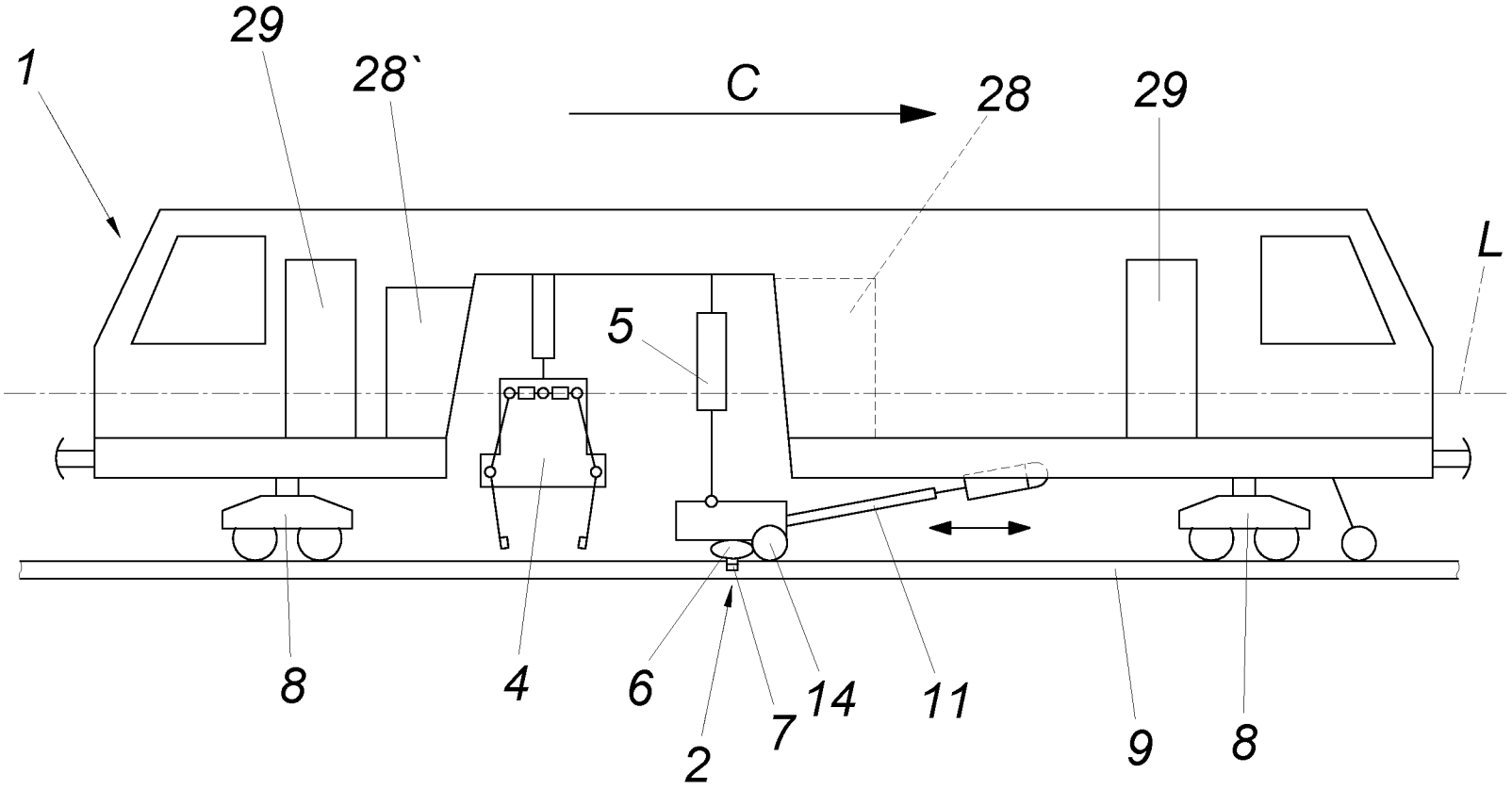
FIG. 1 shows a side view of a track-driveable tamping machine.
Figure 2:
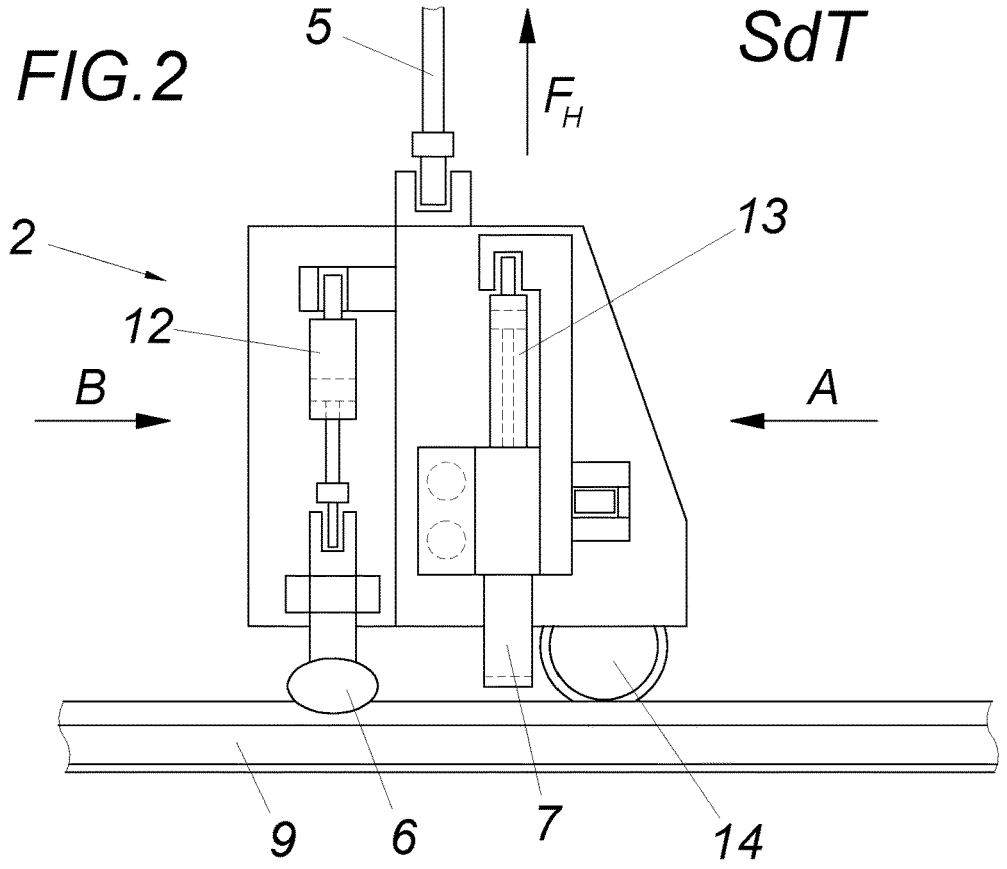
FIG. 2 shows a lifting and lining device with a roller pincer and transversely movable and depth-adjustable lifting hooks according to the prior art.

A tamping machine 1, in particular a switch tamping machine (FIG. 1), has a tamping unit 4 and a track lifting and lining unit 2 with a lifting cylinder 5, a roller pincer 6 and a lifting hook 7. The lifting and lining unit can be displaced in the longitudinal direction of the track via a hydraulic cylinder 11. The switch tamping machine is movable via running gears 8 on the track 9. The control of the switch tamping machine 1 takes place from the working cabin 28 arranged in the direction of operation C in front of the tamping unit 4. The working cabin 28 and the driver's cab can be entered via lateral doors 29. The working cabin 28' is used in the case of mere track tamping.

Figure 3:
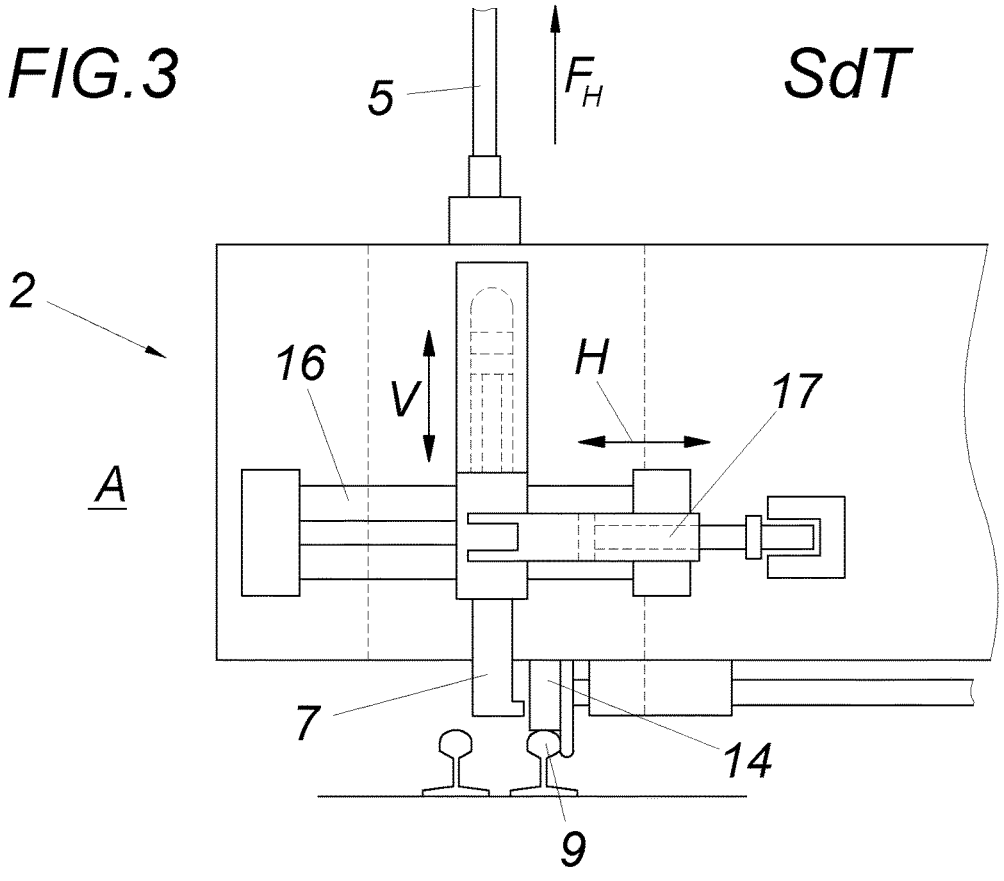
FIG. 3 shows a section of the device from FIG. 2 in a front view (A)
Figure 4:
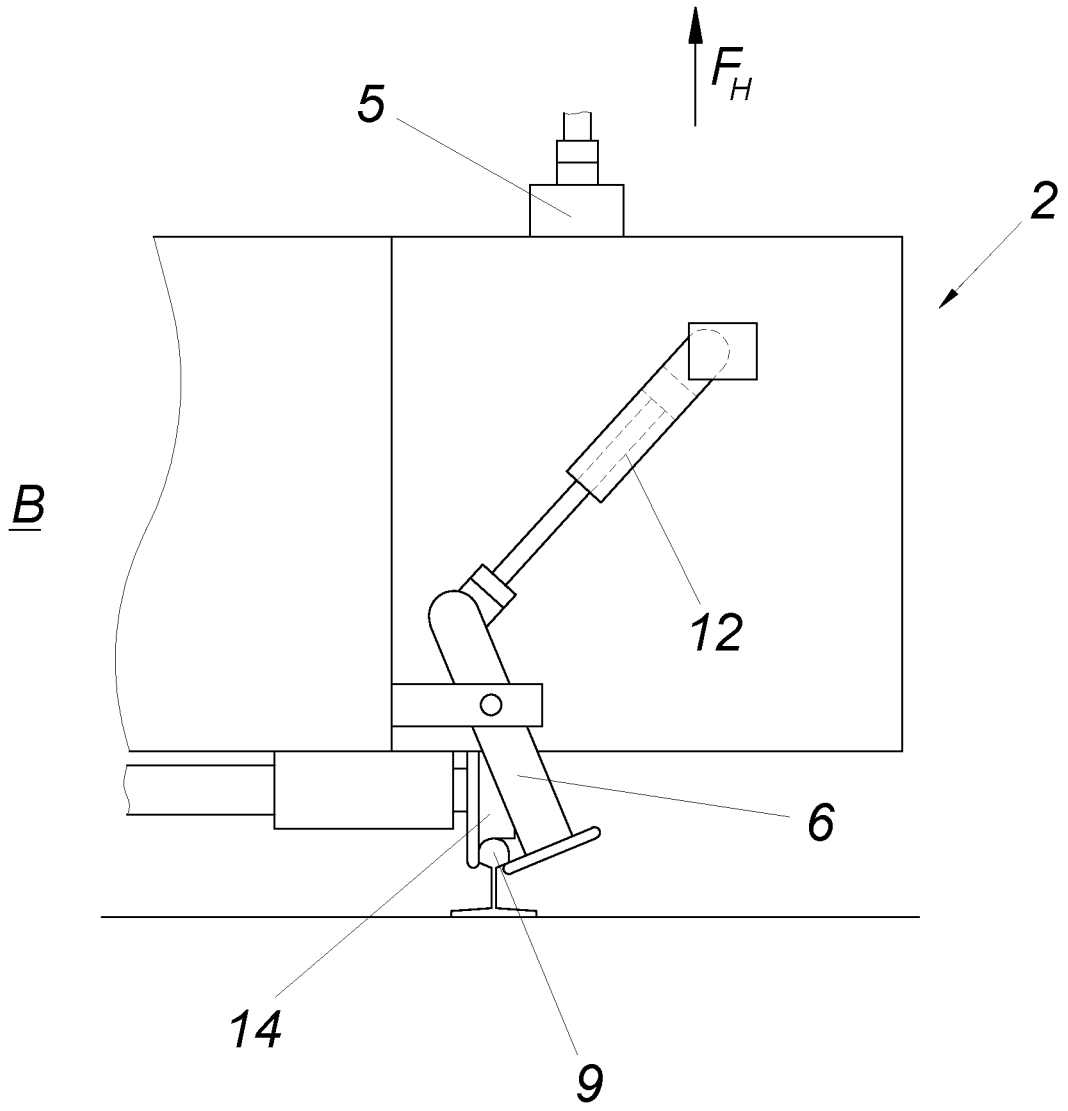
FIG. 4 shows a front view of the roller pincers of FIG. 2.

A lifting and lining unit (FIGS. 2 to 5) comprises a roller pincer 6, a roller pincer closing cylinder 12, a lifting cylinder 5 with the lifting force FH, a hook depth cylinder 13 for the lifting hook, a lifting hook 7 and a guide lining wheel 14. The lifting and lining unit 2 is guided along the rail 9 via wheels 14. The view according to FIG. 3 shows the guide device 16 for the transverse displacement of the lifting hook 7, the lifting hook displacement cylinder 17, the guide lining wheel 14, the lifting cylinder 5 and the guide rail 9. FIG. 4 shows the roller pincer 6, the roller pincer closing cylinder 12, the lifting cylinder 5 with the lifting force FH, the guide rail 9 and the guide lining wheel 14.

Figure 5:
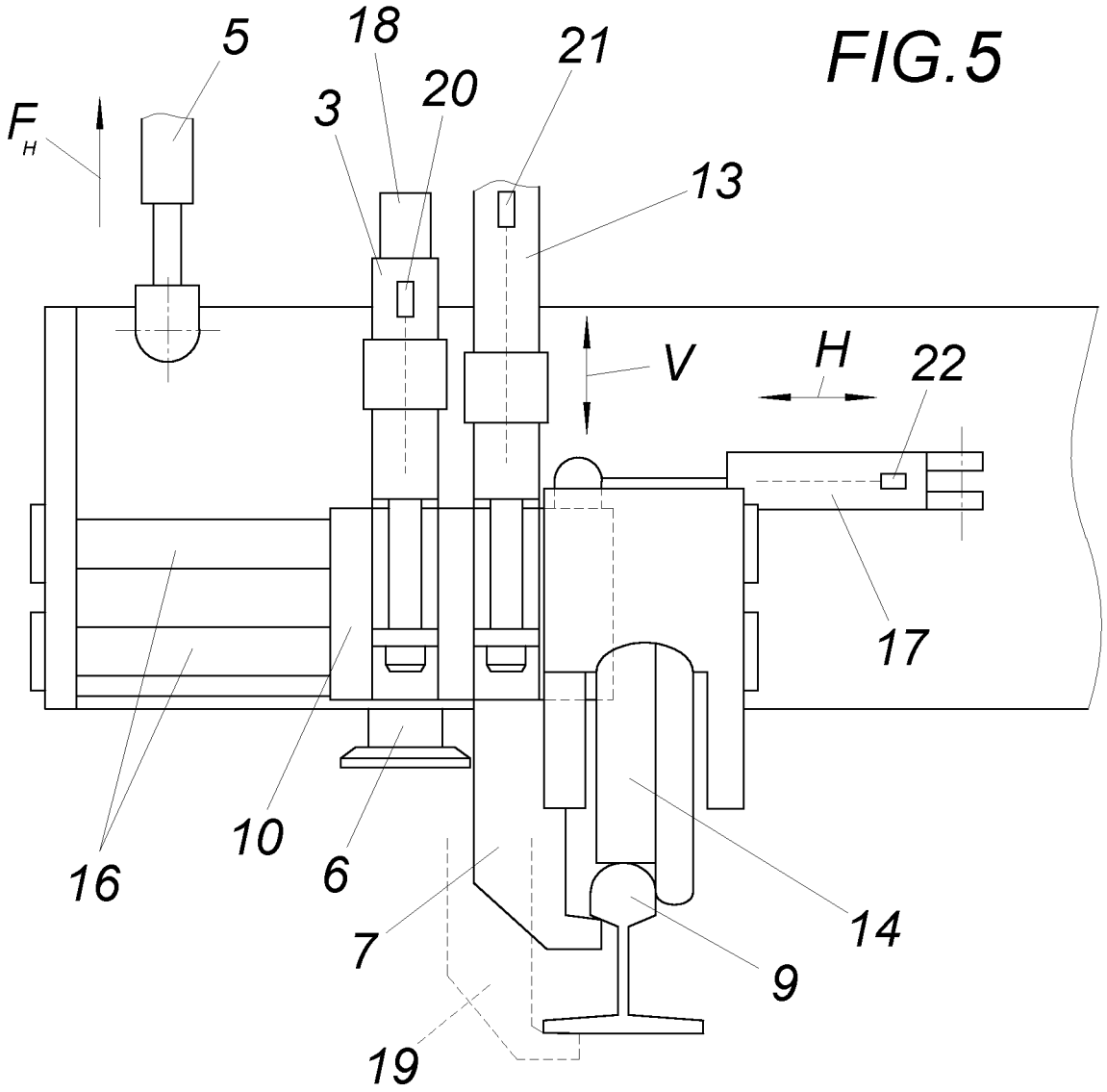
FIG. 5 shows a lifting and lining device according to the invention with vertically adjustable lifting hook and lifting roller
Figure 6:
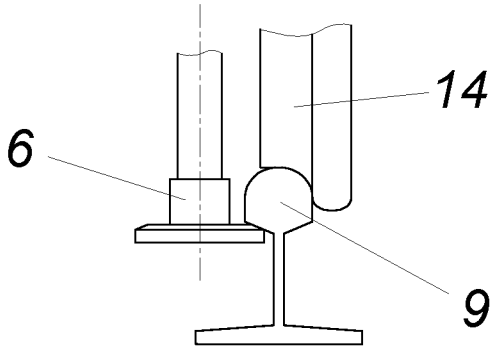
FIG. 6 shows the lifting roller according to the invention in the working position and FIG. 7 shows a side view of the lifting and lining device according to the invention from FIG. 5 with vertically adjustable lifting hook and lifting roller.

The embodiment of the lifting and lining unit 2 in accordance with the invention as shown in FIG. 5 illustrates the common bracket 10, the vertical guide cylinders 3, 13 of the lifting roller 6 and the lifting hook 7 with a vertical lifting movement V with lifting travel sensors 20, 21, the common transverse guide 16, two guide rods arranged one above the other, the displacement cylinder 17 with the transverse displacement path H and the displacement sensor 22, the guide lining wheel 14, the lifting roller 6, the lifting hook 7 in the closed position on the rail head and in the closed position 19 (dashed line) on the rail base, the rail 9, the lifting cylinder 5 with the lifting force $F_H$. The view according to FIG. 6 shows, according to the invention, the interlocking connection between the vertically guided lifting roller 6, the guide lining wheel 14 and the rail 9.

Figure 7:
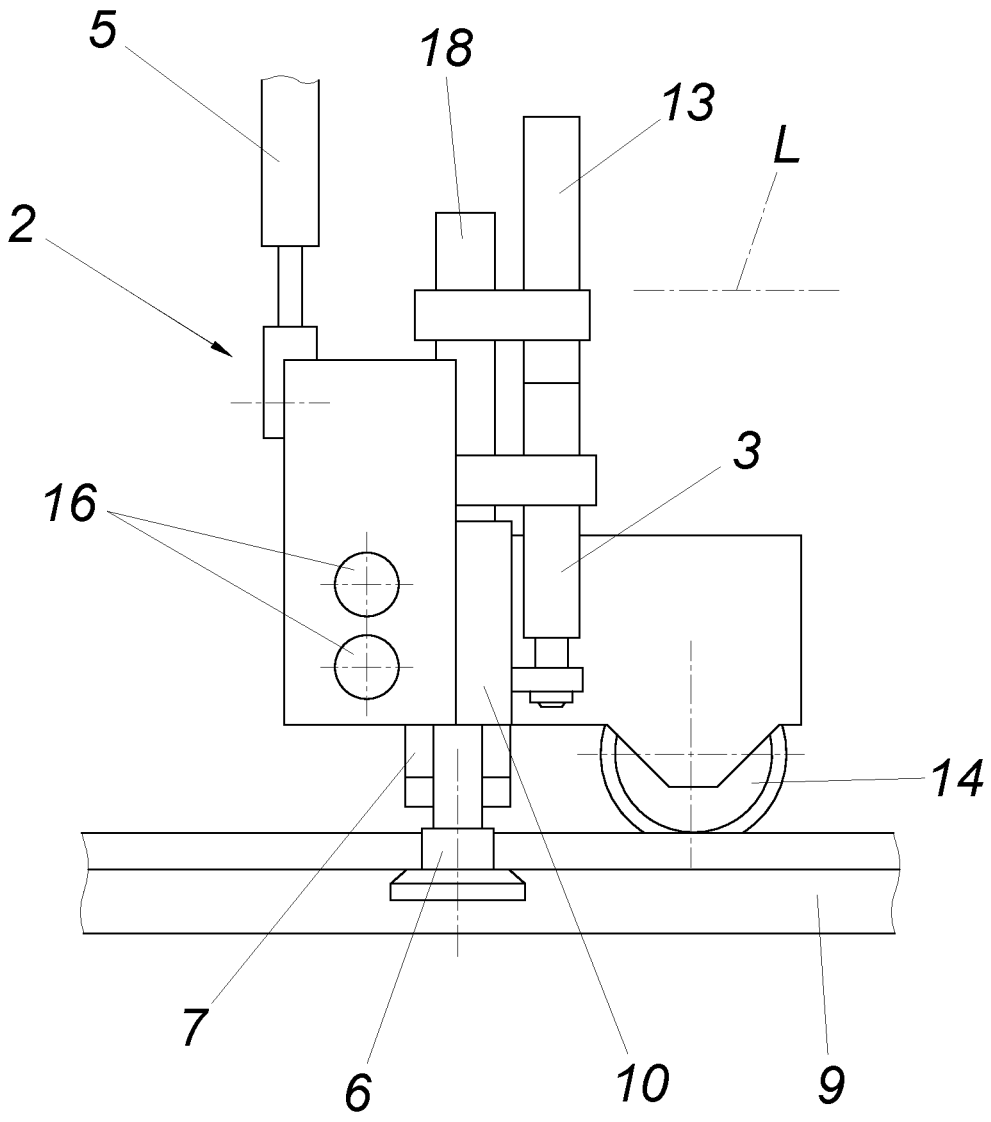

FIG. 7 shows the lateral view of the lifting and aligning unit 2 according to the invention, comprising the transverse guides 16, the vertical guide 18, the vertical lifting cylinders 3, 13 for the lifting roller 6 and the lifting hook 7, the common displacement bracket 10 and the guide lining wheel 14.

The invention claimed is:

1. A tamping machine for compacting the ballast bed of a track, comprising:

tamping units tamping the track, said tamping units having a lifting and lining device lifting and lining tracks and switches, said device being arranged between running gears and comprising a lifting roller and a lifting hook, wherein the lifting roller and the lifting hook each has associated therewith a respective vertical guide, and the lifting roller and the lifting hook each moves in a respective vertical path independently of each other on the respective vertical guide, and the lifting roller and the lifting hook and the associated vertical guides are displaceably mounted along a common transverse guide extending transversely to a longitudinal axis of the tamping machine so as to be transversely movable.

2. The tamping machine according to claim 1, wherein the lifting roller with the associated vertical guide and the lifting hook with associated vertical guide are arranged in a common bracket and are displaceably mounted with the bracket along the common transverse guide.

3. The tamping machine according to claim 2, wherein the lifting roller and the lifting hook each has a respective vertical guide cylinder, and the lifting roller and the lifting hook and the vertical guide cylinders thereof are associated with the common bracket and the bracket is displaceably mounted with a transverse displacement cylinder along the transverse guide.

4. The tamping machine according to claim 3, wherein a displacement sensor is associated with the transverse displacement cylinder, a first lifting travel sensor is associated with the vertical lifting cylinder of the lifting roller, and a second lifting travel sensor is associated with the vertical lifting cylinder of the lifting hook.

5. The tamping machine according to claim 4, wherein the displacement sensor of the displacement cylinder, the lifting travel sensor of the vertical lifting cylinder for the lifting roller and the lifting travel sensor of the vertical lifting cylinder for the lifting hook are integrated into the respective cylinders, which are hydraulic.

6. The tamping machine according to claim 2, wherein the lifting roller has a vertical guide cylinder and the lifting hook has a vertical guide cylinder, and the lifting roller and the lifting hook and the vertical guide cylinders thereof are associated with the common bracket and the bracket is displaceably mounted with a transverse displacement cylinder along the transverse guide.

7. The tamping machine according to claim 6, wherein a displacement sensor is associated with the transverse displacement cylinder, a first lifting travel sensor is associated with the vertical lifting cylinder of the lifting roller, and a second lifting travel sensor is associated with the vertical lifting cylinder of the lifting hook.

8. The tamping machine according to claim 7, wherein the displacement sensor of the displacement cylinder, the lifting travel sensor of the vertical lifting cylinder for the lifting roller and the lifting travel sensor of the vertical lifting cylinder for the lifting hook are integrated into the respective cylinders, which are hydraulic.

9. The tamping machine according to claim 1, wherein said device is arranged between the running gears in front of the tamping units in a working direction.

10. The tamping machine according to claim 5, wherein said device is arranged between the running gears in front of the tamping units in a working direction.

11. The tamping machine according to claim 8, wherein said device is arranged between the running gears in front of the tamping units in a working direction.

* * * * *